United States Patent [19]

Taylor

[11] 4,124,974

[45] Nov. 14, 1978

[54] YARN TWIST ARRANGEMENT

[75] Inventor: Jimmy Taylor, Candler, N.C.

[73] Assignee: Akzona Incorporated, Asheville, N.C.

[21] Appl. No.: 790,934

[22] Filed: Apr. 26, 1977

[51] Int. Cl.[2] ..... D01H 7/92

[52] U.S. Cl. ..... 57/339; 57/348; 85/1 SS; 151/14 R; 151/24

[58] Field of Search ..... 57/77.4, 77.45; 151/14 R, 14.5, 24; 85/1 SS

[56] References Cited

U.S. PATENT DOCUMENTS

| | | | |
|---|---|---|---|
| 2,376,829 | 5/1945 | Sokolowsky | 151/24 X |
| 3,203,460 | 8/1965 | Kuhne | 151/14 R |
| 3,885,378 | 5/1975 | Schuster | 57/77.45 |
| 3,932,985 | 1/1976 | Naylor | 57/77.4 |

*Primary Examiner*—Charles Gorenstein
*Attorney, Agent, or Firm*—Craig & Antonelli

[57] ABSTRACT

A yarn friction false twist arrangement which includes a base plate having arranged thereon at least three equiangularly spaced shafts, each of which is provided with a plurality of axially spaced friction disks. The disks are arranged on the respective shafts and the base plate in an overlapping manner so as to define a path of travel for a strand of yarn. One of the shafts is fixedly connected with respect to the base plate and the other shafts are mounted so as to be displaceable with respect to the base plate with a device being provided for adjusting a position of one of the displaceably mounted shafts. An arrangement is provided at the base plate for securing the adjusting device in an adjusted position with a locking construction being provided for locking the adjusting device at the base plate.

7 Claims, 3 Drawing Figures

YARN TWIST ARRANGEMENT

The present invention relates to a yarn twist arrangement and, more particularly, to a yarn friction false twist arrangement which includes a plurality of parallel, equiangularly spaced rotary devices, at least two of which are adjustable.

Yarn friction false twist devices of the aforementioned type have been proposed, for example, in U.S. Pat. No. 3,932,985, wherein three parallel, equiangularly spaced shafts are provided with each of the shafts including axially spaced friction disks which overlap one another such that a strand passing through the center of the construction follows a zig-zag path. To permit the arrangement to operate under optimum conditions for a yarn of a given denier and/or yarns of different deniers and/or other varying properties or characteristics, the axes of the spaced shafts as well as the axial spacing of the disks are adjustable.

To adjust the center spacing for a given yarn, a centering gauge is interposed between a stationary shaft and two adjustable shafts with the centering gauge being configured so as to seat itself at the stationary shaft with the adjustable shafts then being brought into contact with a peripherial surface of the centering gauge and subsequently locked in position.

Normally, at least one of the adjustable shafts is pivotally mounted at a base plate and is adjustable by loosening a locking collar and turning an adjusting screw until a coned portion of the screw contacts an angled machine surface of a movable pivot arm on which the adjustable shaft is mounted. Subsequently, the locking collar is then tightened so as to secure the adjusting screw.

One disadvantage of the proposed construction resides in the fact that, upon a tightening of the locking collar, the adjusting screw also turns, thereby leading to inaccuracy in a center spacing of the shafts adversely affecting the yarn being processed.

The aim underlying the present invention essentially resides in improving a yarn false twisting device of the aforementioned type. For this purpose, a locking construction is provided for securing the adjusting screw after an adjustment thereof so as to eliminate the possibility of subsequent turning by the adjustment screw during a tightening of the locking collar.

According to one feature of the present invention, at least one securing arrangement is provided at the base plate which is brought into engagement with a portion of the adjusting screw to secure the same without damage to the screw threads and without turning the adjusting screw.

Preferably, according to the present invention, the securing arrangement includes a member, constructed of malleable material, arranged in the area of the adjusting screw which is displaced so as to be brought into engagement with the adjusting screw by a further adjusting member prior to the locking of the locking collar.

According to yet another feature of the present invention, the adjusting element is constructed as a set screw accommodated in a bore which also accommodates the malleable material member. The bore is provided with a threaded portion having a sufficient axial length so as to ensure a locking of the adjusting screw when said malleable material member is brought into engagement therewith.

According to a still further feature of the present invention, so as to permit the utilization of more or less conventional set screws and minimize the tapping of the threads in the bore, a relatively rigid member is interposed between the set screw and the malleable material member.

Preferably, according to the present invention, the bore means is arranged in the base plate of the yarn twisting arrangement and extends at a right angle with respect to the longitudinal axis of the adjusting screw so as to ensure a secure locking of the adjusting screw by the malleable material member.

Accordingly, it is an object of the present invention to provide a yarn twisting arrangement which avoids, by simple means, the aforementioned drawbacks and shortcomings encountered in the prior art.

Another object of the present invention resides in providing a yarn twisting arrangement which ensures a more accurate setting of the center spacing and also reduces the time for setting up the yarn twisting arrangement.

Yet another object of the present invention resides in providing a yarn twisting arrangement which includes a securing construction which can readily be installed and removed without any difficulties.

A still further object of the present invention resides in providing a yarn twisting arrangement which is simple in construction and relatively inexpensive to manufacture.

These and other objects, features and advantages of the present invention will become more apparent from the following description when taken in connection with the accompanying drawing which shows, for the purposes of illustration only, one embodiment in accordance with the present invention, and wherein.

Figure 1:
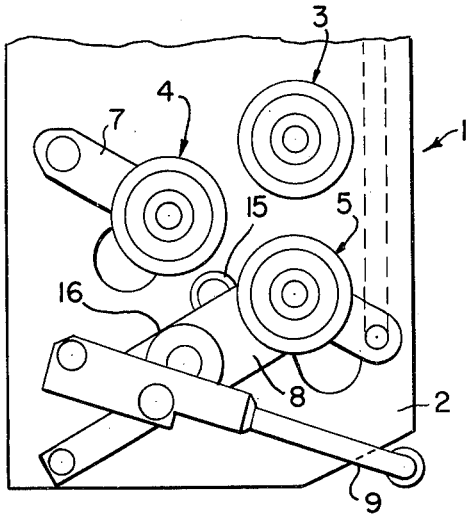
FIG. 1 is a plan view of a yarn twisting arrangement in accordance with the present invention.

Referring now to the drawing wherein like reference numerals are used throughout the various views to designate like parts and, more particularly, to FIG. 1, according to this Fig., a yarn friction false twist device generally designated by the reference numeral 1 is provided which includes a base plate 2 having mounted thereon a relatively fixed shaft having a first set of disks generally designated by the reference numeral 3. Two adjustable sets of disks generally designated by the reference numerals 4, 5, respectively, are arranged on arms 7, 8 pivotally mounted on the base plate 2. An adjusting and/or locking handle 9 may be provided for facilitating the pivotal displacement of the pivot arm 8 and set of disks 5 and a locking of such arm in an adjusted position with a further adjusting handle (not shown) being provided for the pivot arm 7 to facilitate adjustment and/or locking of the pivot arm in a set position.

Figure 2:
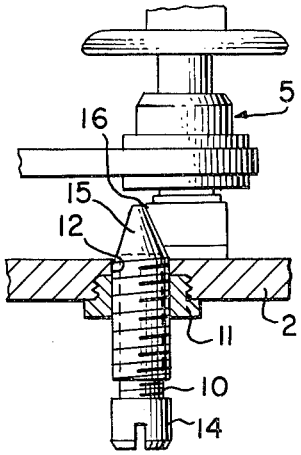
FIG. 2 is a partial cross-sectional view of an adjusting arrangement for one of the shafts of the yarn twisting arrangement of FIG. 1.

As shown in FIG. 2, an adjusting arrangement is provided which includes an adjusting screw 10 threadably receivable in a locking collar 11 which, in turn, is threadably received in a bore 12 provided in the base plate 2. The adjusting screw 10 is provided at one end with a slotted head 14 or the like for accommodating an adjusting tool. The other end of the adjusting screw 10 is provided with a conical adjusting surface portion 15 which is engageable with a machined surface 16 of the pivot arm 8. As readily apparent from FIG. 2, upon an adjusting of the screw 10, the conical adjusting surface portion 15 causes a fine adjustment of the pivot arm 8.

Figure 3:
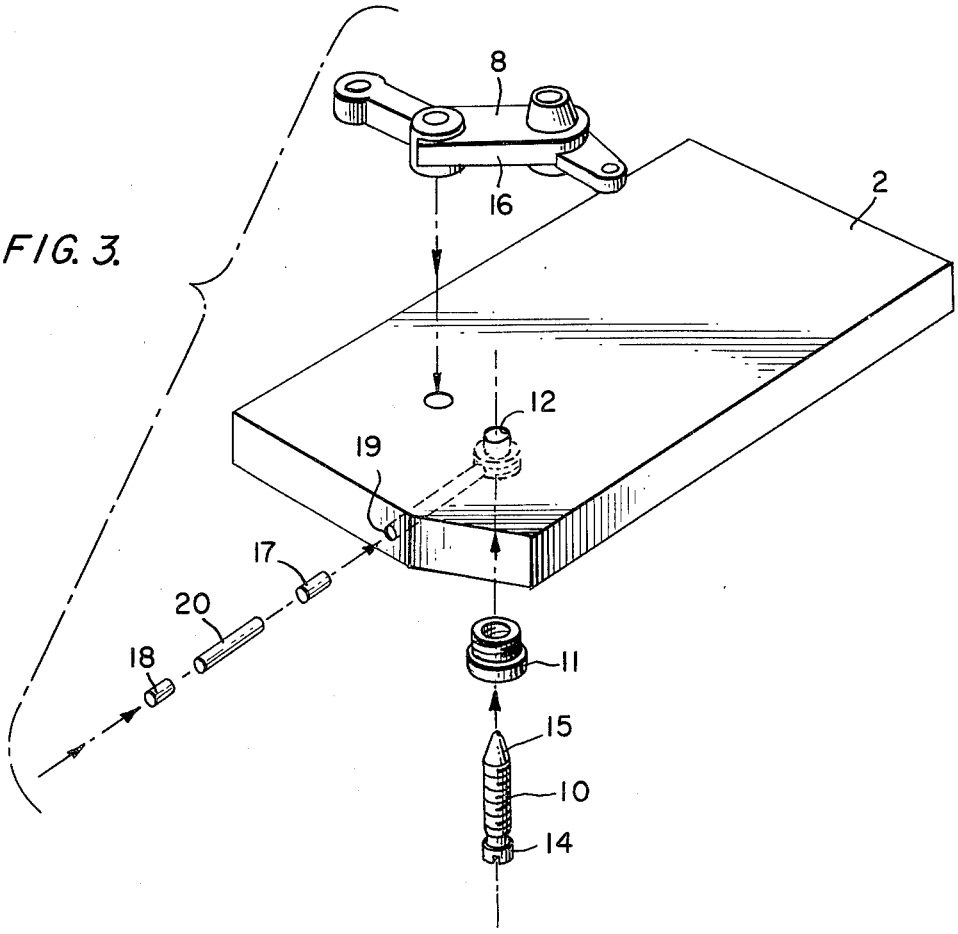
FIG. 3 is an exploded view of a securing construction for a yarn twisting arrangement in accordance with the present invention.

As shown in FIG. 3, a further bore 19 is provided in the base plate 2 extending at a right angle to the longitudinal axis of the bore 12. A member 17 of malleable material is inserted into the bore 19 so as to be engageable with a shank of the adjusting screw 10. The bore 19 terminates in the bore 12 at a position above the top of the locking collar 11 when such collar is inserted into the bore 12 at its maximum insertion depth so as to permit the member 17 to come into engagement with the shank of the adjusting screw 10.

A rod-shaped member 20 is accommodated in the bore 19 and is interposed between an adjusting member such as, for example, a set screw 18 or the like. The bore 19 is tapped internally with a sufficient threaded portion so as to accommodate the set screw 18 and provide a sufficient force on the rod 20 so as to press the malleable material member 17 against the shank portion of the adjusting screw 10. As apparent, the set screw 18 may be provided with a slotted head, a bolt head, or a socket for accommodating an adjusting tool.

In a setting-up operation, a convention center gauge (not shown) is arranged between the respective shafts mounting the disks 3, 4, 5, and the adjusting screw 10 is adjusted until the pivot arm 8 engages a surface of the centering gauge, whereupon the set screw 18 is tightened so as to force the member 17 into engagement with the adjusted screw 10. Subsequently, the locking collar is threadably tightened so as to fix the pivot arm 8 in the adjusted position.

While I have shown and described only one embodiment in accordance with the present invention, it is understood that the same is not limited thereto, but is susceptible of numerous changes and modifications as known to those skilled in the art, and I therefor do not wish to be limited to the details shown and described herein, but intend to cover all such changes and modifications as are encompassed by the scope of the appended claims.

What is claimed is:

1. A yarn friction false twist arrangement which includes a base plate, at least three equiangularly spaced shafts arranged on the base plate, a plurality of friction disks arranged on each of the shafts such that the disks on respective shafts overlap to define a path for a strand of yarn, one of said shafts being fixedly connected with respect to the base plate and the other shafts each being mounted on a moveable mounting means so as to be displaceable with respect to the base plate, the improvement comprising:

said moveable mounting means comprising a pivot arm means that is arranged on the base plate for mounting one of the displaceably mounted shafts;

means for adjusting a position of one of the displaceably mounted shafts with respect to the base plate and the remaining shafts by contacting said moveable means, said adjusting means including an adjusting surface means for engaging a portion of said pivot arm means to displace said pivot arm means upon an adjusting of said adjusting means;

means provided at the base plate for engaging and accommodating said adjusting means;

means arranged at the base plate for securing said adjusting means in an adjusted position in contact with said moveable mounting means without changing the adjusted position and without effecting further movement of said mounting means, said securing means comprising a first member formed of malleable metal arranged at the base plate for directly engaging a portion of said adjusting means to prevent a movement thereof after said adjusting means has been adjusted and at least one additional member arranged at the base plate operatively associated with said first member for pressing said first member into engagement with said adjusting means; and a locking collar arranged in said accommodating means for locking said adjusting means at the adjusted position and relative to said base plate, said locking collar being provided with an internal threaded portion and an external threaded portion, said external threaded portion being operable with a threaded portion provided in said accommodating means, and said adjusting means being provided with a threaded portion cooperable with internal threaded portion of said collar.

2. An arrangement according to claim 1, wherein said adjusting means includes a screw member having a shaft portion that is engaged by said securing means, said shaft portion threadably engaging said base plate, and wherein said adjustable surface means includes a conical surface provided at one end of said screw member.

3. An arrangement according to claim 2, wherein said at least one additional member is a set screw.

4. A yarn friction false twist arrangement which includes a base plate, at least three equiangularly spaced shafts arranged on the base plate, a plurality of friction disks arranged on each of the shafts such that the disks on respective shafts overlap to define a path for a strand of yarn, one of said shafts being fixedly connected with respect to the base plate and the other shafts each being mounted on a moveable mounting means so as to be displaceable with respect to the base plate, the improvement comprising:

means for adjusting a position of one of the displaceably mounted shafts with respect to the base plate and the remaining shafts by contacting said moveable means;

means provided at the base plate for engaging and accommodating said adjusting means;

means arranged at the base plate for securing said adjusting means in an adjusted position in contact with said moveable mounting means without changing the adjusted position and without effecting further movement of said mounting means, said securing means comprising a first member formed of a malleable metal arranged at the base plate for directly engaging a portion of said adjusting means to prevent a movement thereof after said adjusting means has been adjusted, and at least two additional members arranged at the base plate operatively associated with said first member for pressing said first member into engagement with said adjusting means; and a locking collar arranged in said accommodating means for locking said adjusting means at the adjusted position and relative to said base plate, said locking collar being provided with an internal threaded portion and an external threaded portion, said external threaded portion being cooperable with a threaded portion provided in said accommodating means, and said adjusting means being provided with a threaded portion cooperable with the internal threaded portion of said collar.

5. An arrangement according to claim 4, wherein said adjusting means includes a screw member.

6. An arrangement according to claim 5, wherein one of said at least two members is a screw member threadably inserted into the base plate, a second of said at least two members is a relatively rigid rod member interposed between said screw member and said first member.

7. A yarn friction false twist arrangement which includes a base plate, at least three equiangularly spaced shafts arranged on the base plate, a plurality of friction disks arranged on each of the shafts such that the disks on respective shafts overlap to define a path for a strand of yarn, one of said shafts being fixedly connected with respect to the base plate and the other shafts each being mounted on a moveable mounting means so as to be displaceable with respect to the base plate, the improvement comprising:

a screw member for adjusting a position of one of the displaceably mounted shafts with respect to the base plate and the remaining shafts by contacting said moveable means;

means provided at the base plate for engaging said accommodating said screw member;

means arranged at the base plate for securing said screw member in an adjusted position in contact with said moveable mounting means without changing the adjusted position and without effecting further movement of said mounting means, said securing means comprising a first member formed of malleable metal arranged at the base plate for directly engaging a portion of said screw member to prevent a movement thereof after said screw member has been adjusted, and at least two additional members arranged at the base plate operatively associated with said first member for pressing said first member into engagement with said screw member; and a locking collar arranged in said accommodating means for locking said screw member at the adjusted position and relative to said base plate, said locking collar being provided with an internal threaded portion and an external threaded portion, said external threaded portion being cooperable with a threaded portion provided in said accommodating means, and said screw member being provided with a threaded portion cooperable with the internal threaded portion of said collar.

* * * * *